US005490917A

United States Patent [19]

Lazaro et al.

[11] Patent Number: 5,490,917

[45] Date of Patent: Feb. 13, 1996

[54] ELECTROPLATING DEVICE & PROCESS

[75] Inventors: Anton E. Lazaro, Park Ridge, Ill.; William Yates, Las Vegas, Nev.

[73] Assignee: Hardwood Line Manufacturing Co., Chicago, Ill.

[21] Appl. No.: 337,083

[22] Filed: Nov. 10, 1994

Related U.S. Application Data

[63] Continuation-in-part of Ser. No. 149,442, Nov. 9, 1993, Pat. No. 5,419,823.

[51] Int. Cl.[6] ..... C25D 17/20

[52] U.S. Cl. ..... 205/143; 204/212; 204/213

[58] Field of Search ..... 204/212, 213; 205/143

[56] References Cited

U.S. PATENT DOCUMENTS 5,057,202 10/1991 Mattino ..... 204/212

5,139,039 8/1992 Yates ..... 134/95.1

OTHER PUBLICATIONS

*Electroplating Engineering Handbook*, 3rd Ed., A. Kinweth Graham, Ed., Van Nostrand Reinhold Co., New York (1971) p. 619.

*Primary Examiner*—Kathryn Gorgos
*Assistant Examiner*—Brendan Mee
*Attorney, Agent, or Firm*—Irwin C. Alter

[57] ABSTRACT

This invention relates to a process and apparatus for electroplating that has an electrolyte continually circulating through a rotating plating barrel along with its parts to be plated by having a nozzle spray means with perforation on an elongated perforated tube that is positioned above the center of a barrel, whereby the spray means barrel is provided with recirculated electrolyte by means of a pump recirculating electrolyte from a plating tank to the elongated perforations while the barrel is rotating, so that the parts are agitated and greater speed and efficiency of the plating process can be achieved.

22 Claims, 3 Drawing Sheets

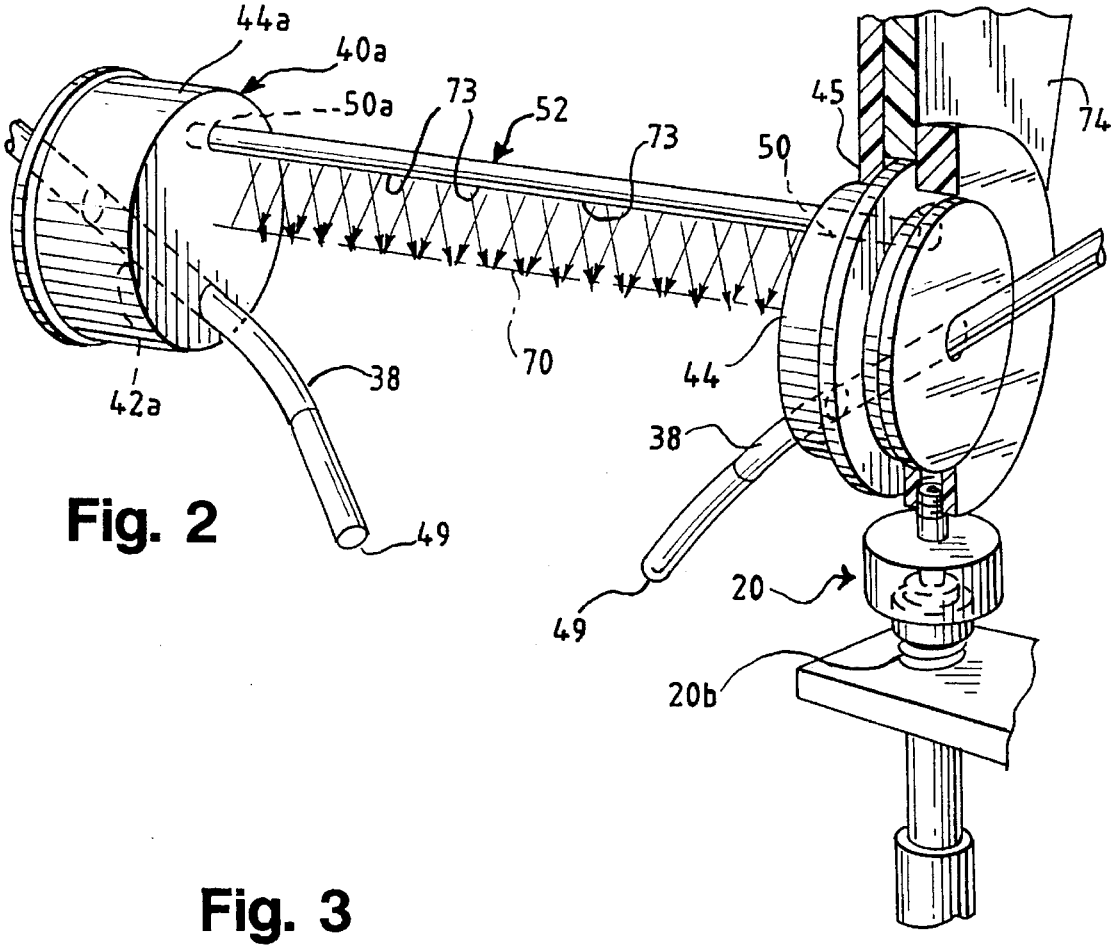
Fig. 2
Fig. 3
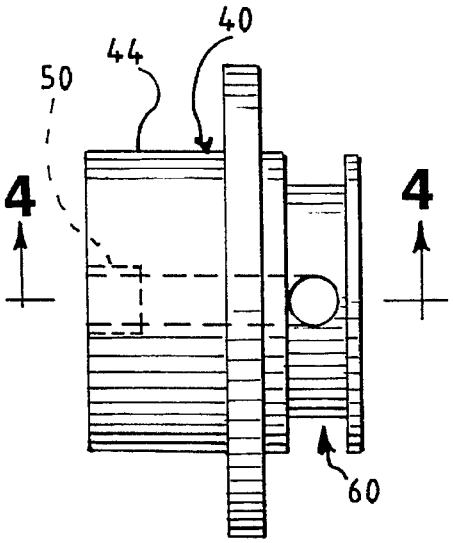
Fig. 4
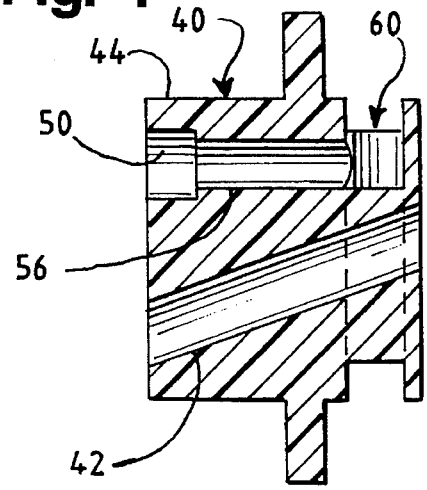

ELECTROPLATING DEVICE & PROCESS

This application is a continuation-in-part depending from our previous application entitled IMPROVED ELECTROPLATING DEVICE AND PROCESS filed Nov. 9, 1993, under Ser. No. 08/149,442 now U.S. Pat. No. 5,419,823.

This invention relates generally to an improved way to recycle electrolytic fluid from and to an electroplating barrel that is plating work pieces supported within the barrel. The invention employs an elongated spray tube with perforations and alternately, a spray means in the form of a nozzle means with perforations as well that are connected to a pumping system continually regenerating electrolyte from the barrel and plating tank so that it can be sprayed through the perforations of the tube. This occurs while the barrel is being rotated, whereby a continual supply of electrolyte can be sprayed downward on the working parts. By having the spray tube placed above the axis of rotation of the barrel, the parts can be better sprayed and covered with electrolyte, while they are being agitated by rotation of the barrel. However, it has been found that with larger parts a spray means with a nozzle employed at the side of the barrel above the axis of rotation can be employed as an improvement.

At the present, the systems known to us are those which are disclosed as follows:

In an electroplating engineering handbook (4th Edition) Chapter 4 on Barrels, by Williams H. Jackson and E. Kenneth Graham, page 458 disclosed in FIG. 10 a cross-sectional view of a perforated horizontal plating barrel with electroplating solution through the cylinder into the barrel. While the solution from the tank is merely pumped from the pump back into the tank through the circulating barrel, in a circulating manner, there is no spray means that is fixedly mounted eccentrically above the axis of rotation of the barrel to have work pieces agitated and constantly sprayed with recirculated electrolyte to obtain an efficient and speedy electroplating of parts.

As disclosed in the Patent to Yates, U.S. Pat. No. 5,139,039, issued Aug. 18, 1992, there is a suitable and efficient water rinsing means and process that utilizes a perforated spray tube that extends along across the axis of rotation; but this is only used for rinsing and does not teach or suggest the use of or how to provide a stationary spray tube mounted above the axis of rotation for the use of such system for electroplating. With an elongated perforated tube or nozzle means mounted eccentrically, as in our present invention, the plating is accomplished more efficiently due to better and more thorough spraying of parts since the spray has an overall larger spray from being mounted higher in the barrel to achieve speedier electroplating.

U.S. Pat. No. 1,916,465, issued to J. L. Dawson, also shows a barrel that has an axially mounted tube provided with perforations that has an axially mounted tube provided with perforations that is connected with an inlet pipe. While the inlet pipe is adapted to admit electrolyte and disperse it into the interior of the drum so as to replace the more or less spent electrolyte in the drum, there is no teaching of a perforated spray means above the axis for spraying parts and the means to accomplish this.

SUMMARY AND OBJECTS OF THE INVENTION

Accordingly, it is an object of the present invention to provide a method and apparatus for plating a plurality of parts that are supported within a rotating plating barrel, that is positioned in a plating tank. The apparatus comprises the combination of a spray means embodied in the form of a stationary perforated elongated spray tube located within a rotating plating barrel and communicating with one end of a flexible inlet hose by means of a coupling device that has the spray tube communicating therewith through an annular hub device to enable recirculated electrolyte pumped under pressure to be forced through the stationary perforated tube, which is mounted eccentrically above the axis of the barrel for achieving an improved result in plating. The spray means can also be in the form of a nozzle as will be explained hereafter.

The interconnecting of the inlet hose with the annular hub device is done by means of a coupling device similar to the one described in U.S. Pat. No. 5,139,039 where there can be a pair of coupling portions such a magnetic attracting coupling plates and whereby the plates are pushed together in locking relationship, and they are sealed with appropriate seal means such as gaskets or the like. With one of the coupling portions in our device attached to and communicating with the annular hub, electrolyte can be forced under pressure to the spray means by means of being forced up both sides of an annular portion of the annular hub and thereby enable the spray means which are immobily mounted above the barrel axis to spray the agitated parts from a stationary position above while still enabling the barrel to rotate.

BRIEF DESCRIPTION OF THE DRAWINGS

Referring more particularly to the accompanying drawings which show a preferred embodiment of our invention for illustrative purposes only:

FIG. 2 is a pictorial view illustrating how the coupling devices as connected to the plating barrel enable electrolyte to be pumped up through an annular hub device into the eccentrically mounted stationary perforated spray tube;

FIG. 3 is a side view of the annular hub device showing the annular portion thereof that creates a passageway from the coupling members to the spray tube while the plating barrel rotates;

FIG. 4 is a sectional view of the annular device taken on a plane passing through line 4—4 and illustrating a passageway communicating with the annular portion thereof on one side and the perforated spray tube on the opposite side thereof.

DESCRIPTION

Figure 1:
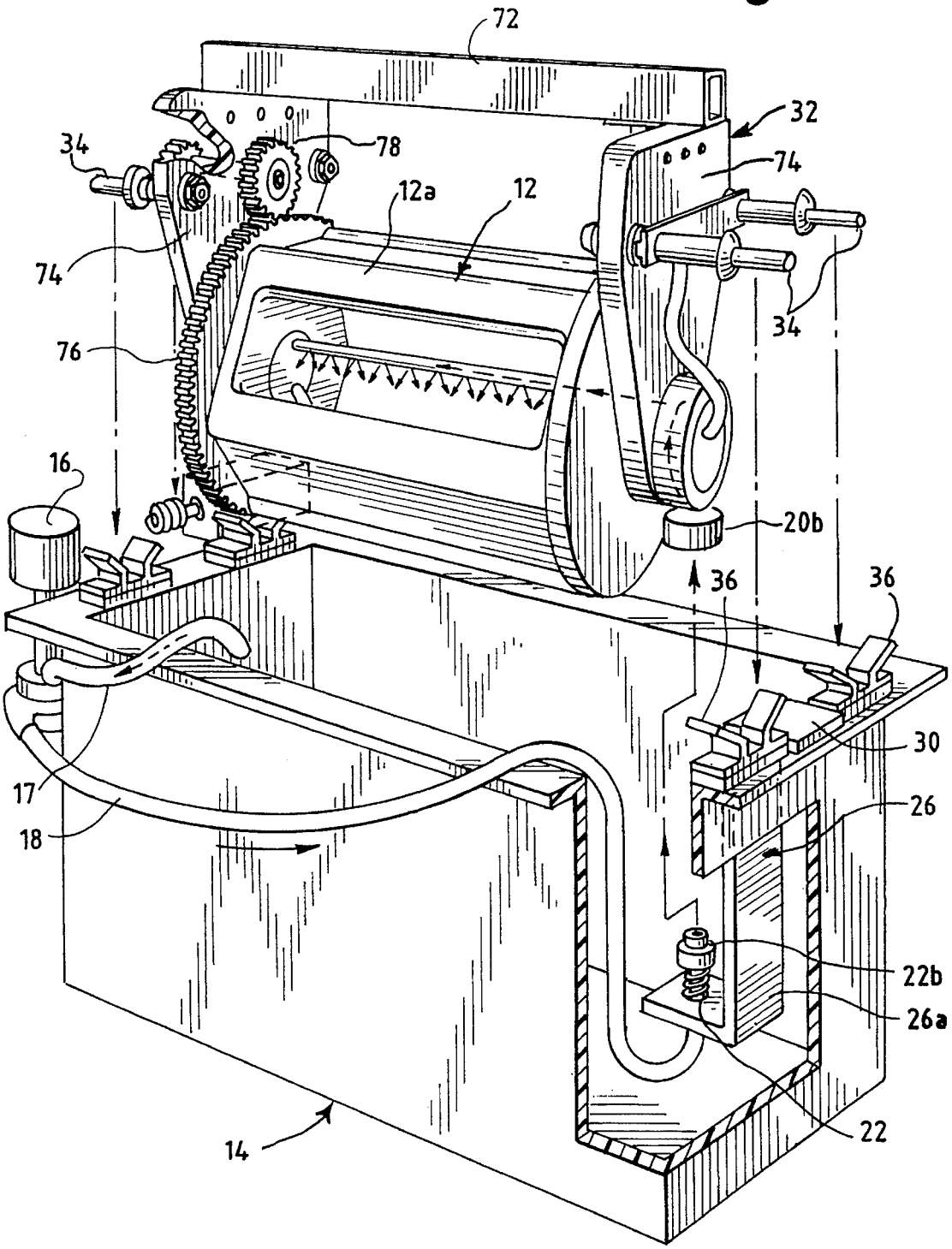
FIG. 1 is a pictorial view of a plating tank with the walls broken away to illustrate how a plating barrel can be supported therein and have a coupling device attached for purposes of enabling the pumping of recycled electrolyte from the tank back to the barrel via a perforated stationary spray tube eccentrically located above the central axis of the plating barrel.

Referring to FIG. 1, a plating barrel 12 having sidewalls **12*a* is shown above a plating tank 14 that includes a pumping system including a pump 16 which is shown attached and connected to the tank 14 by a conduit 17 which enables pumping the electrolyte out of tank 14 and recirculating it through the recirculating conduit portion 18 after it has been pumped through conduit 17. The recirculating conduit 18 which is connected to a coupling device 20 through a lower spring-biased coupling member 20***a* that has a spring 23 disposed and sized to fit around the end 22 of recirculating conduit 18. The lower spring-biased coupling member 20*a* is associated with conduit 18 on one side and is supported by a bottom portion 26*a* of the bracket 26 which is shown as preferably being "z" shaped, and urging the coupling member 20*a* upward when the spring 23 is compressed and resting on the bottom portion 26*a* of the bracket 26.

As seen from FIGS. 3 and 4, the coupling member 20*a* is flexible and movable. The coupling device 20 also has an upper barrel coupling member 20*b* that is shaped to receive the lower spring biased coupling member 20*b* when the plating barrel 12 is lowered down into the tank. The flexible and movable coupling member 20*b* enables it to be put in registry with the coupling member 20*b* of the coupling device 20 which can have gaskets along with magnets for creating a seal in a conventional manner when the coupling members 20*a*, 20*b* are engaged. The lower spring biased coupling member 20*b* which is shown in FIGS. 1 and 2 is secured in engagement by the force of spring 23 being pressed down against the bracket 26 at the bottom portion 26*a* thereof. As was noted in U.S. Pat. No. 5,139,029, coupling members of this sort can be magnetic and the coupling devices can be held together by magnetism and sealed by seals as well as gaskets pressed into engagement by means of the spring exerting a force equal and opposite to the weight and force of the barrel, as illustrated in FIGS. 2 and 3.

As seen from FIG. 1, the bottom portion of 26*a* of the "z" shaped bracket extends upward through an intermediate portion 26*b* to the upper portion 26*c*, which is removable associated with the tank 14 at the opening 30 formed by the cradle contact means 36.

Thus, once the barrel 12 is lowered so that the coupling members 20*a* and 20*b* are pushed together with a force that maintains a positive seal between them to lock the coupling device 20, the recirculating conduit 38 is in communication with the plating barrel 12.

Figure 5:
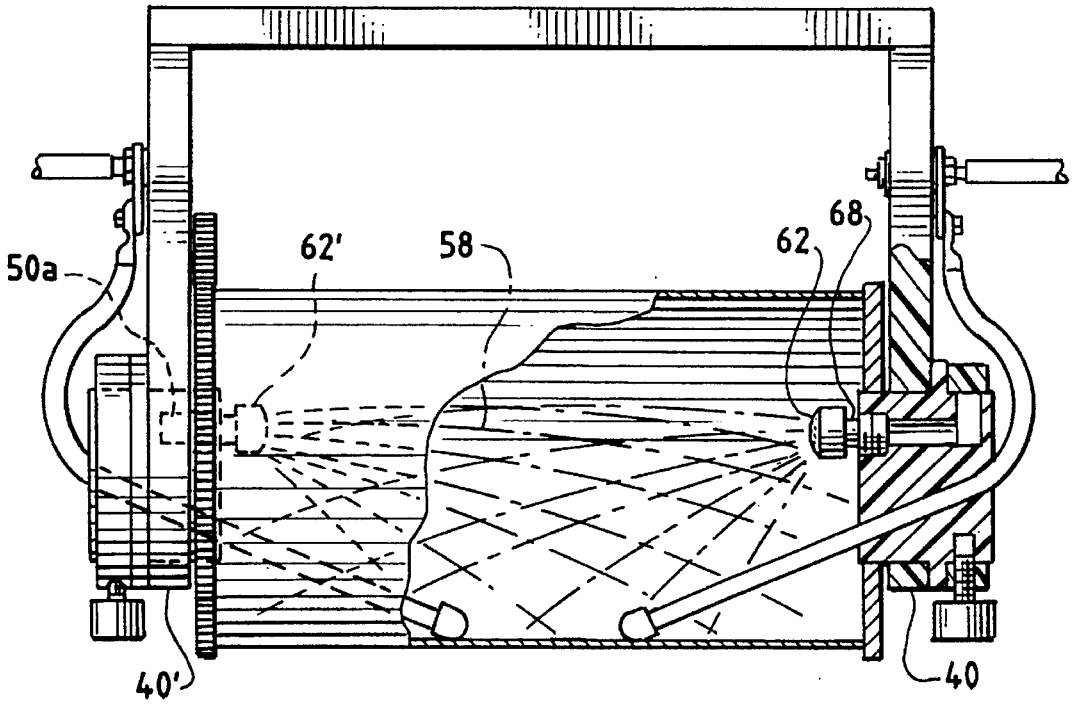
FIG. 5 is a side elevational view of another embodiment of the invention where the spray means is a nozzle or a plurality of nozzles (one nozzle is shown in phanton)

The plating barrel 12 is constructed very similar to existing ones so that the supporting frame structure 32 is provided with the support lugs or pins 34 which rest on the cradle members 36. These lugs 34 also make up part of the electrical system necessary to provide electric power for electroplating. Two cables 38 are connected to each set of lugs 34 and enter the annular hub means 40, and the other hubs means 40*a* by means of the annular passage ways 42, 42*a* which are shown in FIGS. 2 and 4. The annular hub means 40 is shown as having a bearing means 44 containing the journal portion 46 of the supporting legs 16 as shown in FIGS. 4 and 5. The cables or danglers 38 pass through the passageways 42 and extend into the barrel to define a pair of oppositely disposed electrodes 49 at the end of the danglers 38. It should be noted that the hub means 40*a* is the same as the annular hub means 40, except that it does not have the annular portion, or the liquid passageways of the annular hub means 40. As seen from FIG. 2, the hub means 40, 40*a* are oppositely disposed and are both stationary to one another to form the center around which the plating barrel 12 rotates.

The plating barrel 12 is adapted to receive a spray means in the form of a perforated elongated spray tube 52 which is shown mounted within the walls of the barrel and attached to the barrel hub means 40, 40*a* by cylindrical shaped receiving means 50, 50*a*. As seen from the drawings, the annular hub means 40 has the annular portion 60 that communicates with the tube 52 by means of the passageway 56. As seen from the drawing, the passageway 56 communicates with the coupling device 20 when the spring biased coupling means 20*a* and the barrel coupling means 20*b* are engaged in their locked position as shown in FIG. 2.

Another spray means that has been found effective in those cases where it is desirable to plate larger parts that can get entangled with the spray tube 52. In this modification, the spray tube 52 can be removed and one or a plurality of spray nozzles 62,62' can be provided in place of the spray tube 52 as seen in FIGS. 5 and 6 wherein the nozzles 62,62' are shown connected to the cylindrical shaped receiving means 50,50*a* which can be connected to the hub means 40,40*a* that are both connected to electrolyte under pressure so that the similar portions of the hub means can move liquid through the nozzles from electrolyte schematically shown in FIG. 5 and FIG. 6.

In FIG. 5, nozzle 62 is shown as spraying the work pieces from one end of the barrel. If it is desired to have another nozzle at the opposite end of an electrolyte source (shown schematically) it can be coupled with the hub member 40' that is essentially like hub means 40 and electrolyte can be forced therethrough to the nozzle 62' shown in phanton whereby electrolyte can be sprayed in the spray pattern of nozzle 62 to more completely spray the work pieces.

Figure 6:
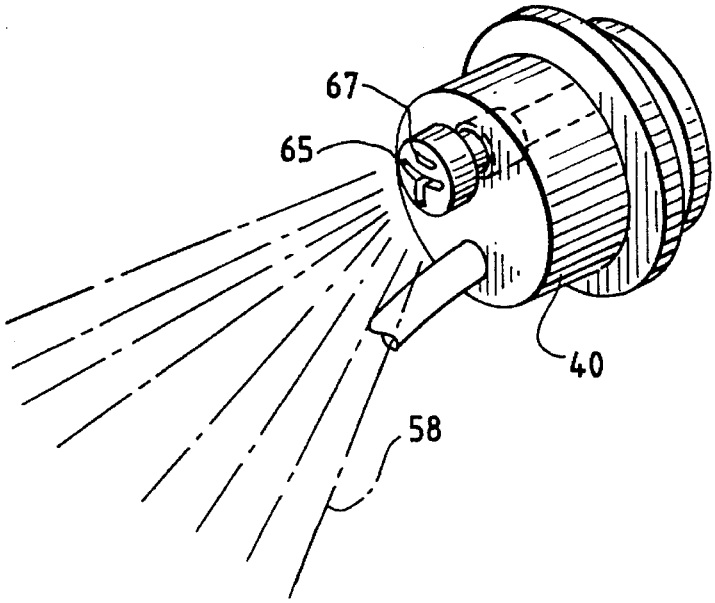
FIG. 6 is a pictorial exploded view of one of the nozzles of FIG. 5.

In FIG. 6 the nozzle 62 is shown as having a "T" shaped slit 65 and a horizontal orifice 67 whereby electrolyte under pressure can be created in a vertical spray 58 across the barrel as well as horizontally.

Figure 7:
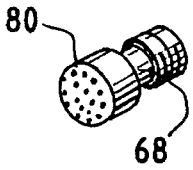
FIG. 7 is a pictorial exploded view of a nozzle that has apertures perforated therein randomly.

In FIG. 7 an apertural nozzle 80 is shown with randomly placed apertures 80*a*, that can be used with or instead of the "T" shaped slits 65 or horizontal orifices 67 that are pictured in FIG. 6.

The nozzles 62, 62' and 80 can be removably attached by being threaded and being associated with a threaded closed nipple 68,68' that can be removably associated with the cylindrical housed holding means 50,50'.

Therefore, when the electroplating barrel 12 has been lowered to the position where the coupling device 20 is locked, electrolyte is drawn from the tank 14 by the pump 16 and finally through the recirculating conduit 18 which communicates with the coupling device 20 and annular portion 60, whereby the recirculated electrolyte is disbursed to the barrel and the parts that are in the barrel by being sprayed by means of the apertures 73 in the elongated spray tube 52 or the slits or apertures 63,63' in the nozzle(s) 62,62'.

The barrel 12 is rotatably mounted on the journaling portions 44,44*a* of the hubs 40,40*a* which are located in the depending side by member 16 to enable the barrel 12 to rotate about its central axis 70 while the elongated spray tube 52 or nozzle(s) 62,62', which are mounted upward of the axis remain stationary since they are mounted at each end in the cylindrical shaped cavity tube holding means 50, 50*a* as seen in FIG. 2. The elongated spray tube 52 is mounted so that the apertures 73 formed therein are directed in a relatively downward direction to guide a spray or stream of electrolyte that enhances the ability of the parts to be plated by causing the electrolyte to contact the parts more efficiently when the parts are being agitated. Since the spray tube 52 as well as the nozzle(s) 62,62', 80 are located above the central axis 70, parts can be piled higher in the barrel and greater dielectric dispersion and electrical contact can be made with the parts to enhance and speed up the plating process. The side walls 12*a* of the barrel are also perforated to allow free flow of the processing electrolyte so that the largest number of surfaces of the parts are sprayed.

The frame structure 32, in further including a substantially horizontal cross beam 72 that interconnects depending side members 74 as shown in FIG. 1 of the drawings, provides a means of transporting the barrel up and down or from tank to tank as is common in plating. The barrel 12 has two opposite ends 54 with one of them fixedly associated with a gear 76 that is driven by a pinion gear 78, which can be in turn associated with a motor to cause the plating barrel 16 to rotate.

As stated earlier, spraying of the electrolyte creates more of a thorough contact with the parts. The top parts in the barrel that are agitated, but not submerged, can be sprayed and the electrolyte can be recirculated as before mentioned. With the plating barrel 12 mounted so that it is removably positioned in the cradles 36 of the tank structure 14, the barrel is selectively immersed in dielectric in the tank and the spray means 52, which is located above the central axis 70 of the plating barrel and causing the parts to be more thoroughly mixed with the electrolyte to create improved plating action. By recirculating the dielectric with the pump 16 and causing the electrolyte to be forced through the annular portion, we not only are able to locate the spray means above the central axis, but also we are able to prevent the interruption of liquid by means of clogging on one side of the annular opening, since both sides of the annular portion would have to be clogged in order to preclude the electrolyte from being recirculated. This advantage together with providing a unique and elegant arrangement of the stationary spray means above the central axis enhances the performance of the barrel by making it more efficient.

It should be realized that the nozzles with the different type apertures shown can be employed with the different orifices and slits that have been found to provide certain enhanced characteristics where the length, width and/or size of the pieces to be plated require these different characteristics. Thus, while the nozzles have specific openings 65, 67 and 80(*a*) shown with enhanced characteristics, this invention is divided into combinations of the apertures with the nozzles and other elements of the invention that deliver the improvements here upon which protection has been sought.

It may thus be seen that the objects of the present invention set forth herein as well as those made apparent from the foregoing description are efficiently obtained. While preferred embodiments of the invention have been set forth for purposes of disclosure, modification of disclosed embodiments of the invention as well as other embodiments thereof may occur to those skilled in the art. Accordingly, the appended claims are intended to cover all embodiments which do not depart from the spirit and scope of the invention.

What we claim is:

1. An apparatus for providing a spray of a recirculated electrolyte fluid from a source onto a plurality of parts that are disposed within a rotatable plating barrel that agitates the parts by its rotation comprising:

a tank adapted to receive and cooperate with the plating barrel in removable engagement;

spray means extending within said plating barrel for spraying the parts with electrolyte, said spray means mounted eccentrically with respect to a central axis of said plating barrel a predetermined distance above the central axis and said parts; and at least one hub means in communication with said spray means and with the source of the fluid for directing the fluid under pressure from the source to said spray means;

whereby enhanced and more efficient electroplating of parts can be accomplished.

2. The apparatus as defined in claim 1, wherein said hub means has an annular portion in selective communication with said fluid source and formed to communicate with said spray means when connected in communication therewith to enable said spray to be fed from opposite directions and thereby enhances the flow of the liquid being forced through said annular portion.

3. The apparatus, as defined in claim 1, wherein said spray means comprises a spray tube mounted at each end of said barrel and having a plurality of apertures to spray said parts from above said central axis of the barrel.

4. An apparatus as defined in claim 1, wherein said spray means includes at least one nozzle spray means located at one side of the rotating plating barrel whereby enhanced plating of larger parts can be achieved.

5. An apparatus as defined in claim 4, wherein at least one nozzle spray means is operatively disposed on each side of said plating barrel by being mounted at each end in central hub members that can both communicate with said electrolyte under pressure and said hub members have bearing surfaces that are journalled and cooperate to enable said plating barrel to rotate while said nozzle spray means remains stationary.

6. An apparatus as defined in claim 4, wherein said nozzle spray means has at least one vertical slit therein, thereby causing spraying in a substantially vertical spray pattern on said parts to be plated.

7. An apparatus, as defined in claim 4, wherein said nozzle spray means has at least one horizontal slit defined therein, thereby causing a spray pattern that includes substantial horizontal sprays on said parts to be plated.

8. An apparatus as defined in claim 4, wherein said nozzle spray means includes at least one "T" shaped slit therein, thereby causing a spray pattern that has sprays go in both substantially horizontal and vertical directions to spray electrolyte on the length and width of said parts being plated.

9. An apparatus as defined in claim 8, wherein a horizontal slit is defined above said "T" shaped slit in said nozzle, whereby enhanced spraying of parts to be plated can be achieved.

10. The apparatus as defined in claim 2, wherein said spray means is mounted at each end in a central hub member and said hub members have bearing surfaces that are journaled and cooperate to enable said plating barrel to rotate while said spray means remains stationary.

11. The apparatus as defined in claim 10, wherein a coupling device removably associates said barrel and the fluid source, said coupling device having a barrel coupling member associated with said barrel and another coupling member associated with said fluid source, said barrel coupling member being in communication with said annular opening in one of said hub members, whereby said spray means within said barrel can be connected with said source of recirculated fluid when said barrel is positioned into proximity with said other coupling member to enable said coupling device to be locked into engagement.

12. A method of spraying a plurality of parts to be plated in a plating barrel that is operatively associated with a plating tank containing electrolyte, said barrel including a perforated spray means that sprays electrolyte on the parts below said spray where the barrel can be moved to removably associate it with a source of electrolyte under pressure comprising the steps of:

(a) moving the electroplating barrel into a position where it is removably coupled with the source of electrolyte under pressure;

(b) agitating the parts to be plated in the plating barrel by rotating the plating barrel;

(c) spraying the parts with said electrolyte through the perforated spray means from a fixed position within the plating barrel above the parts and central axis of the plating barrel while said barrel, rotates whereby more efficient electroplating is accomplished.

13. An apparatus for providing a spray of a recirculated electrolyte fluid from a source onto a plurality of parts that are disposed within a rotatable plating barrel that agitates the parts by its rotation comprising:

a tank adapted to receive and cooperate with the plating barrel in removable engagement;

spray means extending within said plating barrel for spraying parts below it with electrolyte;

at least one stationary hub means having a portion in selective communication with said fluid source and having journalling means for enabling said plating barrel to rotate while said spray means is mounted on said hub means and remains stationary, a pair of coupling members, one of said coupling members being associated with said hub member of the barrel and extending from said barrel at a fixed location, the other of said coupling members being positioned in communication with the source of fluid for directing the fluid under pressure to said spray means when said coupling members are in engagement with each other at a fixed location to achieve enhanced and more efficient electroplating of parts.

14. An apparatus as defined in claim 13, wherein said spray means includes at least one nozzle spray means located at one side of the rotating plating barrel whereby enhanced plating of parts can be achieved.

15. An apparatus as defined in claim 14, wherein at least one nozzle spray means is operatively disposed on each side of said plating barrel by being mounted at each end in central hub members that can both communicate with said electrolyte under pressure and said hub members have bearing surfaces that are journalled and cooperate to enable said plating barrel to rotate while said nozzle spray means remains stationary.

16. An apparatus as defined in claim 14, wherein said nozzle spray means has at least one vertical slit therein, thereby causing spraying in a substantially vertical spray pattern on said parts to be plated.

17. An apparatus, as defined in claim 14, wherein said nozzle spray means has at least one horizontal slit defined therein, thereby causing a spray pattern that includes substantial horizontal sprays on said parts to be plated.

18. An apparatus as defined in claim 14, wherein said nozzle spray means includes at least one "T" shaped slit therein, thereby causing a spray pattern that has sprays go in both substantially horizontal and vertical directions to spray electrolyte on the length and width of said parts being plated.

19. An apparatus as defined in claim 18, wherein a horizontal slit is defined above said "T" shaped slit in said nozzle, whereby enhanced spraying of parts to be plated can be achieved.

20. The apparatus as defined in claim 13, wherein said spray means is mounted at each end in a central hub member and said hub members have bearing surfaces that are journalled and cooperate to enable said plating barrel to rotate while said spray means remains stationary.

21. The apparatus as defined in claim 13, wherein said one of said coupling members removably associates said barrel and the fluid source, said coupling device having a barrel coupling member attached to said barrel at the hub member and another coupling member attached to said fluid source, said barrel coupling member being in communication with said barrel through at least one of said hub members, whereby said spray means within said barrel can be connected with said source of recirculated fluid when said barrel is positioned into proximity with said other coupling member to enable said coupling device to be locked in engagement with said other coupling member.

22. A method of spraying a plurality of parts to be plated in a plating barrel that is operatively associated with a plating tank containing electrolyte, said barrel including a perforated spray means that sprays electrolyte on the parts below said spray where the barrel can be moved to removably associate it with a source of electrolyte under pressure and can be rotated while the hub thereof remains stationary by a coupling device wherein at least one of the coupling members is associated with said barrel and extending therefrom in a fixed location with respect to said barrel, the other of said coupling members is located at a fixed position to enable removable engagement with said other coupling member, comprising the steps of:

(a) moving the electroplating barrel into a position where it is removably coupled with the source of electrolyte under pressure;

(b) agitating the parts to be plated in the plating barrel by rotating the plating barrel; and (c) spraying the parts with said electrolyte through the perforated spray means from a fixed position above said parts within the plating barrel while said barrel agitates the parts whereby more efficient electroplating is accomplished.

* * * * *